US005324115A

United States Patent [19]

Weinreb

[11] Patent Number: 5,324,115

[45] Date of Patent: Jun. 28, 1994

[54] CONVERTIBLE BAG

[76] Inventor: Robert Weinreb, 510 Broadway, New York, N.Y. 10012

[21] Appl. No.: 71,763

[22] Filed: Jun. 10, 1993

[51] Int. Cl.[5] ..... B65D 30/10

[52] U.S. Cl. ..... 383/2; 383/86; 190/103

[58] Field of Search ..... 383/2, 86; 190/103, 190/104, 105; 150/112, 114

[56] References Cited

U.S. PATENT DOCUMENTS

| | | | |
|---|---|---|---|
| 1,137,047 | 4/1915 | Bushwick | 190/103 |
| 1,866,241 | 7/1932 | Vineberg | 383/86 X |
| 3,425,470 | 2/1969 | Wuest | 383/2 X |
| 4,919,240 | 4/1990 | Tobias | 190/103 |
| 5,172,838 | 12/1992 | Rowall et al. | 190/103 X |

FOREIGN PATENT DOCUMENTS

| | | | |
|---|---|---|---|
| 0069251 | 5/1949 | Fed. Rep. of Germany | 190/103 |
| 0974498 | 2/1951 | France | 190/103 |

*Primary Examiner*—Allan N. Shoap
*Assistant Examiner*—Jes F. Pascua
*Attorney, Agent, or Firm*—Rosenman & Colin

[57] ABSTRACT

A soft-sided tote bag is convertible between expanded and retracted states by selective operation of a zipper. The interior of the bag is enclosed in both states by two pairs of end flaps.

15 Claims, 2 Drawing Sheets

CONVERTIBLE BAG

BACKGROUND OF THE INVENTION

1. Field of the Invention

This invention generally relates to a bag convertible between expanded and retracted states and, more particularly, to a soft-sided bag whose interior is enclosed to protect accessories in both states.

2. Description of Related Art

It is well known to carry accessories such as camera equipment, computer equipment and the like in a soft-sided tote bag. Although generally satisfactory for its intended purpose, more carrying space within the bag is often needed to handle additional unexpected accessories. To provide such additional space, the art has proposed adding multiple compartments at the exterior of the bag. Yet, the need persists for more carrying space, and especially for protecting the accessories within the bag from rain, dust and like contaminants entering the bag, from falling out of the bag, and from impacts encountered during handling.

SUMMARY OF THE INVENTION

1. Objects of the Invention

It is a general object of this invention to reliably and easily convert a bag between expanded and retracted states.

It is another object of this invention to reliably enclose the interior of a bag in both expanded and retracted states.

Another object of this invention is to reliably protect accessories within the bag from contaminants entering therein, from accessories falling out of the bag, and from impacts encountered during handling.

2. Features of the Invention

In keeping with these objects, and others which will become apparent hereinafter, one feature of this invention resides, briefly stated, in a bag, especially a soft-sided tote bag, which comprises front and rear walls movable toward and away from each other along a first direction between an expanded state in which the front and rear walls are spaced apart by a predetermined distance, and a retracted state in which the front and rear walls are spaced apart by a distance less than said predetermined distance.

The bag further comprises foldable walls extending along the first direction between, and connected to, the front and rear walls to bound a bag interior having a top opening. In the preferred embodiment, the foldable walls include a pair of end walls spaced apart of each other along a second direction normal to said first direction, and a bottom wall extending between, and connected to, the end walls along the second direction.

In accordance with this invention, convertible means are provided for selectively moving the front and rear walls from the expanded to the retracted state with concomitant partial folding of the foldable walls, and for holding the front, rear and foldable walls in the retracted state. In the preferred embodiment, the convertible means includes an elongated fastener extending along the end walls along a third direction normal to said first and second directions, and along the bottom wall along the second direction. The fastener, preferably a zipper, is attached to each end wall and the bottom wall in order to draw together respective peripheral edges of the respective end wall and bottom wall upon movement to the retracted state.

The invention further comprises cover means for covering the top opening and enclosing the bag interior in both the expanded and retracted states. The cover means includes a cover wall mounted for swinging movement between open and closed positions about an axis extending along the second direction. The cover wall has opposite ends spaced apart along the second direction. A pair of end flaps is provided at each end of the cover wall. Each pair of end flaps exteriorly overlies the end walls in each state. The end flaps of each pair overlie each other in the retracted state, and effectively enclose the bag interior in the expanded state. Thus, accessories within the bag are reliably protected from falling out of the bag and, of course, rain, dust and like contaminants are prevented from entering the bag.

Most of the aforementioned walls, including the end flaps, are padded. This feature protects accessories within the bag from shocks and like impacts encountered during handling.

The novel features which are considered as characteristic of the invention are set forth in particular in the appended claims. The invention itself, however, both as to its construction and its method of operation, together with additional objects and advantages thereof, will be best understood from the following description of specific embodiments when read in connection with the accompanying drawings.

DETAILED DESCRIPTION OF THE PREFERRED EMBODIMENTS

Figure 1:
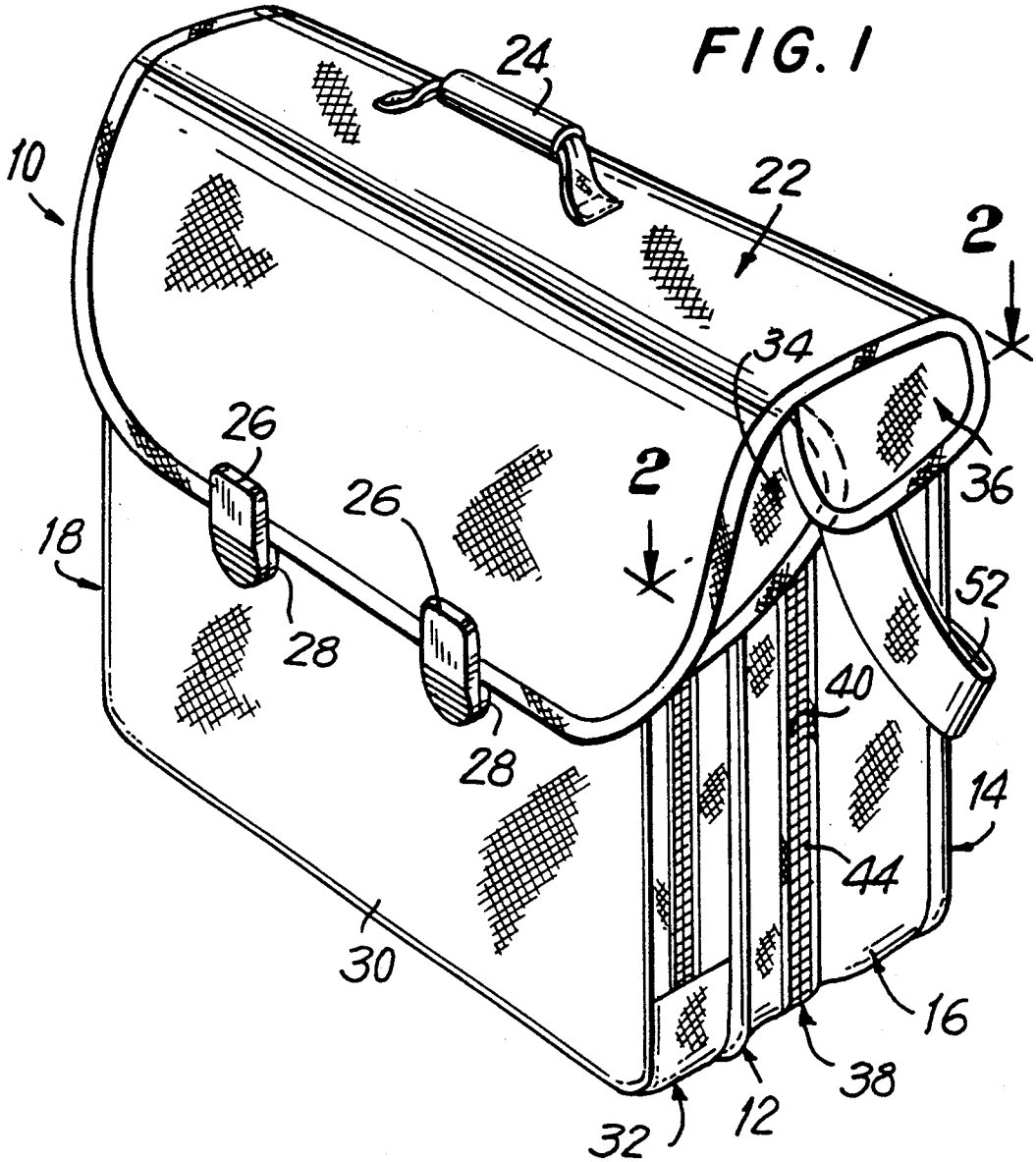
FIG. 1 is a perspective view of a bag in accordance with this invention in a retracted state.

Referring now to the drawings, reference numeral 10 generally identifies a bag having a pair of generally planar front 12 and rear 14 walls movable toward and away from each other along a first direction between an expanded state (FIG. 3) in which the front and rear walls are spaced apart by a predetermined distance, e.g., 6", and a retracted state (FIG. 1) in which the front and rear walls are spaced apart by a shorter distance, e.g. 4", less than said predetermined distance.

Bag 10 also has a pair of generally planar end walls 16, 18 spaced apart of each other along a second direction normal to said first direction, and a generally planar bottom wall 20 extending between, and connected to, the end walls 16, 18 along the second direction.

As described so far, the walls 12, 14, 16, 18, 20 bound a bag interior having a top opening. A cover wall 22 is mounted on the rear wall 14 for swinging movement between an open position in which access is permitted to the bag interior via the top opening, and a closed position in which the cover wall, as shown in FIG. overlies the top opening. A carrying handle 24 is mounted at an upper central region of the cover wall 22. A pair of snap-type connectors 26 is also mounted on the cover wall. In the closed position, the connectors 26 engage with snap action a pair of complementary connectors 28 stationarily mounted on an outer wall 30 of the bag. The outer wall 30 is part of an exterior zippered compartment 32 located in front of the front wall 12. The exterior compartment 32 is entirely optional. In a variant construction, the compartment 32 could be eliminated, in which case, the outer wall and the front wall would be one and the same.

A pair of end flaps 34, 36 is provided at each end of the cover wall 22. Each flap 34, 36 depends downwardly from the cover wall and exteriorly overlies upper portions of the end walls 16, 18.

Figure 2:
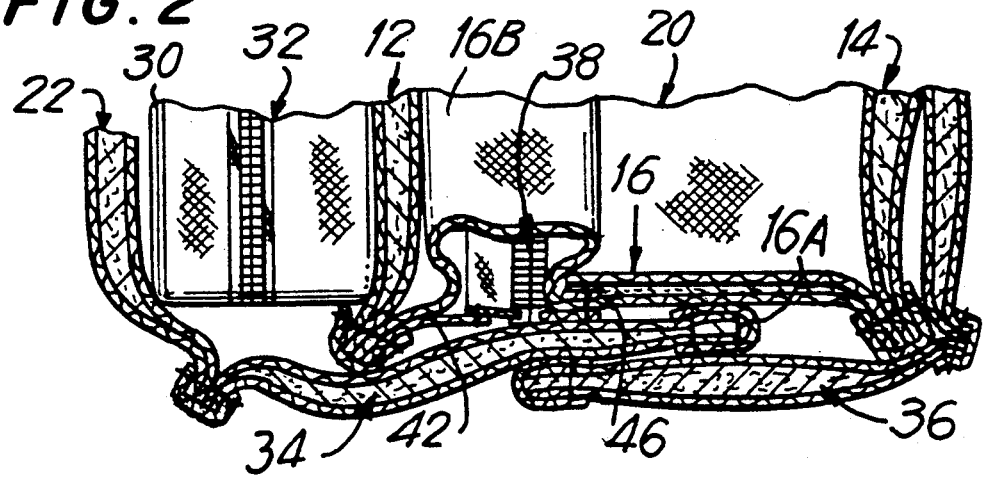
FIG. 2 is a broken-away, sectional view taken on line 2—2 of FIG. 1.
Figure 4:
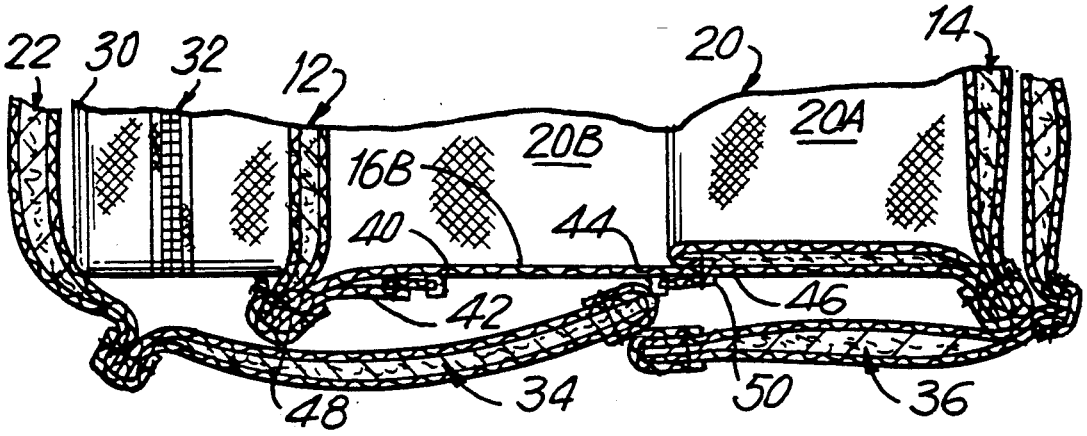
FIG. 4 is a broken-away, sectional view taken on line 4—4 of FIG. 3.

As best shown in FIGS. 2 and 4, the end flaps and all the walls, except for portions of the end walls 16, 18 and portions of the bottom wall 20, are padded. Each padded wall includes an outer fabric material layer, an inner fabric material layer, and a padded or foam insert between the outer and inner layers. The end wall 16 has a padded section 16A and a non-padded section 16B. End wall 18 similarly has a padded and non-padded section (not shown). The bottom wall 20 has a padded section 20A and a non-padded section 20B. The function of the non-padded sections 16B, 20B are described in further detail below.

The bag also includes a slide fastener or pull-operated zipper 38 having a first set of teeth 40 secured to a fabric strip 42, and a second set of interlocking teeth 44 secured to another fabric strip 46. Strip 42 extends vertically along, and is sewn to, an upright peripheral seam 48 on the nonpadded sections of each end wall 16, 18, and also extends lengthwise along, and is sewn to, a horizontal peripheral seam on the non-padded section 20B of the bottom wall 20. Strip 46 extends vertically along, and is sewn to, another upright seam 50 on the padded sections of each end wall 16, 18, and also extends lengthwise along, and is sewn to, another horizontal seam on the padded section 20B of the bottom wall 20.

Figure 3:
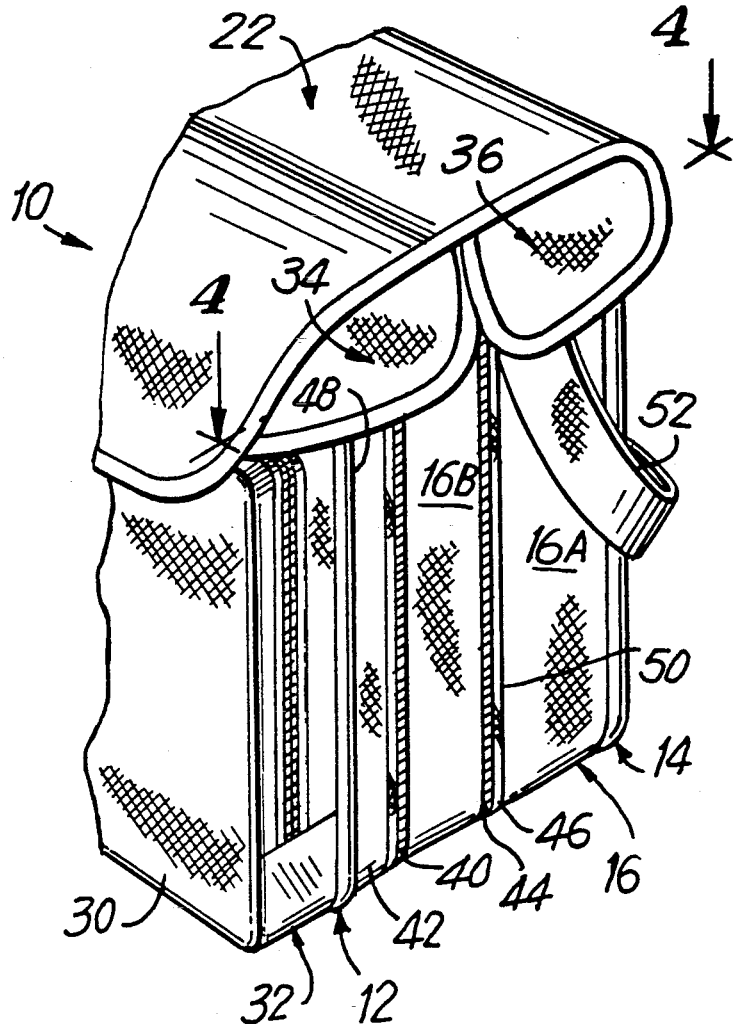
FIG. 3 is a broken-away, perspective view of the bag of FIG. 1 in an expanded state.

The zipper serves as the means for converting the bag between the expanded and retracted states. When the teeth 40, 44 do not interlock and are spaced apart of each other, as shown in FIGS. 3 and 4, the padded and non-padded sections of each end wall and the bottom wall are respectively co-planar, thereby expanding the interior to its maximum volume. Thereupon, when the zipper is manually operated so that the teeth 40, 44 interlock, as shown in FIGS. 1 and 2, the nonpadded sections of the end walls 16, 18 and of the bottom wall 20 at least partially fold up so that the respective non-padded sections are no longer co-planar with their respective padded sections. The closing of the zipper 38 draws together opposite peripheral edges of the non-padded sections, thereby retracting the bag to its minimum volume. The folding of each non-padded section is, of course, facilitated by the lack of padding in each such non-padded section.

As best shown in FIG. 1, the end flaps 34, 36 at least partially overlie and engage each other in the retracted state, thereby insuring that the bag interior is substantially enclosed and any accessories therein safeguarded. In the expanded state, as shown in FIG. 3, the end flaps 34, 36 overlie each other to a lesser extent and, indeed, in a variant construction, are co-planar with each other. In either case, the end flaps 34, 36, even in the expanded state, will continue to serve their function of safeguarding accessories within the bag.

The bag 10 may further include an optional shoulder strap 52 constituted of a nylon webbing material.

It will be understood that each of the elements described above, or two or more together, also may find a useful application in other types of constructions differing from the types described above.

While the invention has been illustrated and described as embodied in a convertible bag, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention and, therefore, such adaptations should and are intended to be comprehended within the meaning and range of equivalence of the following claims.

What is claimed as new and desired to be protected by Letters Patent is set forth in the appended claims.

I claim:

1. A bag, comprising:

(a) front and rear walls movable toward and away from each other along a first direction between an expanded state in which the front and rear walls are spaced apart by a predetermined distance, and a retracted state in which the front and rear walls are spaced apart by a distance less than said predetermined distance;

(b) foldable walls extending along the first direction between, and connected to, the front and rear walls to bound a bag interior having a top opening, each foldable wall having a padded section and a non-padded section;

(c) convertible means for selectively moving the front and rear walls from the expanded to the retracted state with concomitant partial folding of the respective non-padded sections of the foldable walls, and for holding the front, rear and foldable walls in the retractable state; and (d) cover means for covering the top opening and enclosing the bag interior in both the expanded and retracted states.

2. The bag according to claim 1, wherein the front and rear walls are generally planar in both states; and wherein the foldable walls include a pair of end walls spaced apart of each other along a second direction normal to said first direction, and a bottom wall extending between, and connected to, the end walls along the second direction; and wherein the end and bottom walls are generally planar in the expanded state.

3. The bag according to claim 2, wherein the convertible means includes an elongated fastener extending along the end walls along a third direction normal to said first and second directions, and along the bottom wall along the second direction.

4. The bag according to claim 3, wherein each end wall and the bottom wall have peripheral edges, and wherein the fastener is attached to each end wall and the bottom wall to draw together the peripheral edges of a respective end wall and bottom wall upon movement to the retracted state.

5. The bag according to claim 4, wherein the fastener is a zipper having a manually-operated pull.

6. The bag according to claim 2, wherein the cover means includes a cover wall mounted for swinging movement between open and closed positions about an axis extending along the second direction.

7. The bag according to claim 6, wherein the cover wall has opposite ends spaced apart along the second direction, and wherein the cover means further includes a pair of end flaps at each end of the cover wall.

8. The bag according to claim 7, wherein each pair of end flaps exteriorly overlies the end walls in each state.

9. The bag according to claim 7, wherein the end flaps of each pair overlie each other in the retracted state.

10. The bag according to claim 7, wherein each end flap includes padding.

11. The bag according to claim 6, wherein the cover means includes means for locking the cover wall in the closed position.

12. The bag according to claim 2, wherein the front, rear and cover walls includes padding.

13. The bag according to claim 2, wherein each end wall and the bottom wall have padded and non-padded sections.

14. The bag according to claim 1; and further comprising handle means for carrying the bag.

15. A bag, comprising:

(a) front and rear walls movable toward and away from each other along a first direction between an expanded state in which the front and rear walls are spaced apart by a predetermined distance, and a retracted state in which the front and rear walls are spaced apart by a distance less than said predetermined distance;

(b) foldable walls extending along the first direction between, and connected to, the front and rear walls to bound a bag interior and defining a top opening, said foldable walls including a pair of end walls spaced apart of each other along a second direction normal to said first direction, and a bottom wall extending between, and connected to, the end walls along the second direction;

(c) convertible means for selectively moving the front and rear walls from the expanded to the retracted state with concomitant partial folding of the foldable walls, and for holding the front, rear and foldable walls in the retractable state; and (d) cover means for covering the top opening and enclosing the bag interior in both the expanded and retracted states, said cover means including a cover wall mounted for swinging movement between open and closed positions about an axis extending along the second direction, said cover wall having opposite ends spaced apart along the second direction, and a pair of end flaps at each end of the cover wall, each pair of end flaps exteriorly overlying the end walls in each state.

* * * * *